US008807058B1

(12) United States Patent
Roche, IV et al.

(10) Patent No.: US 8,807,058 B1
(45) Date of Patent: Aug. 19, 2014

(54) JET POWERED MULTIHULL NETWORKED VESSEL FOR PROVIDING DIVING SERVICES WITH AN ONBOARD WATER JETTING SYSTEM AND REAL TIME DIVER TRACKING

(71) Applicant: Aqueos Corporation, Broussard, LA (US)

(72) Inventors: Theodore K. Roche, IV, Broussard, LA (US); Bradley M. Parro, Broussard, LA (US); Travis A. Detke, Broussard, LA (US); Mark O. Wieneke, Broussard, LA (US); Troy R. Turner, Broussard, LA (US)

(73) Assignee: Aqueos Corporation, Broussard, LA (US)

( * ) Notice: Subject to any disclaimer, the term of this patent is extended or adjusted under 35 U.S.C. 154(b) by 0 days.

(21) Appl. No.: 14/184,533

(22) Filed: Feb. 19, 2014

Related U.S. Application Data

(60) Provisional application No. 61/767,681, filed on Feb. 21, 2013.

(51) Int. Cl.

| | |
|---|---|
| ***B63B 1/00*** | (2006.01) |
| ***B63B 35/00*** | (2006.01) |
| ***B63C 11/26*** | (2006.01) |
| ***B63B 35/38*** | (2006.01) |
| ***B63H 11/04*** | (2006.01) |
| ***B63B 1/12*** | (2006.01) |

(52) U.S. Cl.
CPC ..... *B63B 35/00* (2013.01); *B63C 11/26* (2013.01); *B63B 35/38* (2013.01); *B63H 11/04* (2013.01); *B63B 1/121* (2013.01)
USPC ..... 114/61.1; 440/38; 715/771

(58) Field of Classification Search
USPC ..... 440/38, 42; 114/61.1; 715/771, 848
See application file for complete search history.

(56) References Cited

U.S. PATENT DOCUMENTS

| | | | | |
|---|---|---|---|---|
| 5,492,076 | A * | 2/1996 | Kobayashi | 114/362 |
| 2006/0228959 | A1* | 10/2006 | Ruiz | 440/42 |
| 2011/0055746 | A1* | 3/2011 | Mantovani et al. | 715/771 |

* cited by examiner

*Primary Examiner* — Lars A Olson
(74) *Attorney, Agent, or Firm* — Buskop Law Group, PC; Wendy Buskop

(57) ABSTRACT

A diving services multihull vessel with a starboard pontoon and a port pontoon, with dive support stations built into the bow and stern, a port independently operable water jet drive operated by a port diesel engine; a starboard independently operable water jet drive operated by a starboard diesel engine; a dive compressor, a water jetting unit, a hydraulic power unit, a decompression chamber, a generator; a fuel tank, an onboard dive server for tracking divers and monitoring dive operations and presenting the information on the display as well as for tracking sensor signals including diver depth, elapsed time of dive, ambient water temperature around a diver, video and/or audio feed from a diver and presenting on a display, as well as transmitting via a network to a location remote to the vessel, wherein the vessel further includes a helm control connected to a navigation control and the jet drives.

21 Claims, 12 Drawing Sheets

JET POWERED MULTIHULL NETWORKED VESSEL FOR PROVIDING DIVING SERVICES WITH AN ONBOARD WATER JETTING SYSTEM AND REAL TIME DIVER TRACKING

CROSS REFERENCE TO RELATED APPLICATIONS

The present application claims priority to and the benefit of U.S. Provisional Patent Application Ser. No. 61/767,681 filed on Feb. 21, 2013, entitled "JET POWERED MULTIHULL NETWORKED VESSEL FOR PROVIDING LIVEBOATING SERVICES WITH AN ONBOARD JET PUMP AND REAL TIME DIVER TRACKING". This reference is hereby incorporated in its entirety.

FIELD

The present embodiments generally relate to a self-supportive jet driven multihull dive vessel or a jet driven multihull dive vessel to be deployed from a host platform, mother ship or dock, for providing dive support services supporting diving operations while providing diver tracking and water jetting operations with those services.

BACKGROUND

A need exists for a shallow draft multihull vessel utilizing twin jet drives to provide safe diving services with superior dive excavation tools and superior acoustic and/or sonar dive tracking tools.

A further need exists for a multihull vessel with twin jet drives, onboard dive compressors, jetting and inspection tools which are high pressure and/or hydraulically operated and wherein the vessel can track divers in the water with acoustics and/or sonar, and provide two way communication between divers in the water to an onboard dive server installed on the multihull vessel and provide bidirectional communication between the onboard dive server and an administrative server remote to the multihull vessel, allowing clients to view status of dive operations with an executive dashboard from the convenience of their laptops, cell phones, or other client devices.

The present embodiments meet these needs.

BRIEF DESCRIPTION OF THE DRAWINGS

The detailed description will be better understood in conjunction with the accompanying drawings as follows.

Figure 1:
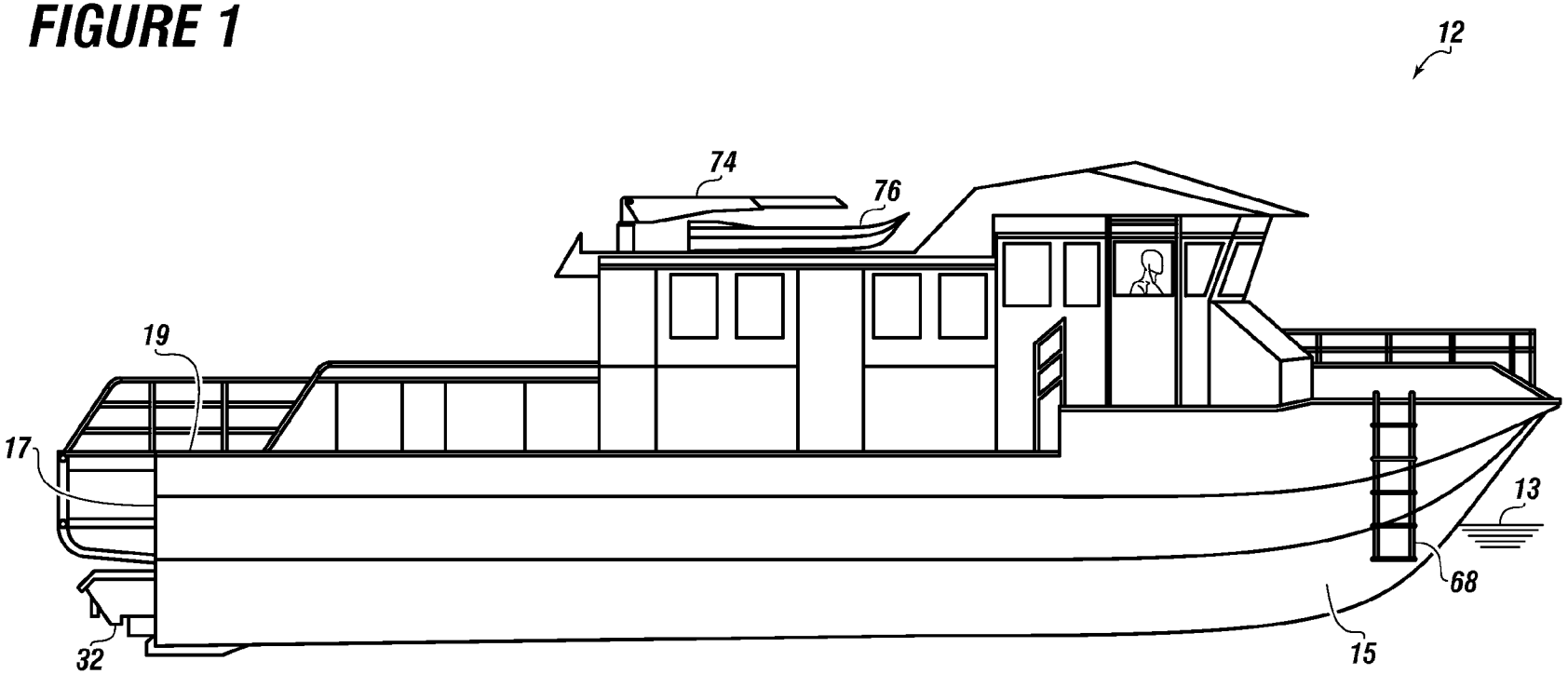
FIG. 1 is a starboard side view of the self-supporting multihull vessel for dive services according to one or more embodiments.

The present embodiments are detailed below with reference to the listed Figures.

DETAILED DESCRIPTION OF THE EMBODIMENTS

Before explaining the present apparatus in detail, it is to be understood that the apparatus is not limited to the particular embodiments and that it can be practiced or carried out in various ways.

The present embodiments generally relate to a self-supportive jet driven multihull dive vessel or a jet driven multihull dive vessel to be deployed from a host platform, mother ship or dock, for providing dive support services supporting diving operations while providing diver tracking and water jetting operations with those services.

Protection of personnel and responsible stewardship of natural resources are needed in dive vessels and sorely missed with current monohull designs that do not use jet drives. Jet drives can reduce bank erosions.

This multihull vessel is designed to prevent incidents enabling diving operations, including liveboating to be safer and enhance production.

The multihull vessel is designed with onboard servers connected to a network allowing divers to communicate with the multihull vessel, and remotely to other client devices with a unique health, safety and environment management system.

This multihull vessel has safe jet propulsion without propellers.

The vessel enhances a safety positive culture by supporting behavior-based and people-based processes which enable safe performance while also protecting natural resources.

The multihull vessel is a versatile and cost effective platform for shallow water diving operations.

A benefit of the multihull vessel is to provide a boat with jet drives to prevent maiming of divers by propellers in diving service vessels while performing diving services that include high pressure water jetting, hydraulic tool operation and other diving tasks, including but not limited to underwater structure inspections.

A benefit of the multihull vessel is that it has the ability to provide dive services in very shallow water of less than 6 feet without fear of propellers cutting up a diver's umbilical or body part or catching a diver or diver equipment.

The shallow draft vessel has enhanced stability by use of a multi-pontoon hull.

The pontoon structure enables the multihull vessel to have improved stability over monohull vessels providing dive services in marginal weather, such as during small craft warning weather.

Another benefit of the multihull vessel is a low freeboard, bow and stern reduces the potential for diver injury during water ingress or egress.

A feature of this multihull vessel is that it has a hull capable of speeds of at least 16 knots and can operate at over 25 knots.

Embodiments of this dive vessel provide a faster response time than other heavy slow dive vessels that provide hydraulic power units and water jetting units for dive operations, and can have 50 percent faster response times.

In an embodiment, the multihull vessel may weigh only 20 to 30 tons for a 55 LOA (length overall) foot vessel.

The multihull vessel can have a length overall (LOA) of less than 115 feet length overall which allows less tie up of space when the vessel is tied to a platform, offshore structure, or another floating vessel, which can result in less chance of damage to a platform or offshore structure because the multihull vessel is short in length and light weight.

The small size allows for a small crew, thereby reducing boat crew operating costs.

The multihull vessel has a built in water jetting unit, allowing divers to hand jet pipelines, and performing other jetting operations, such as moving pigs in a pipeline, or using a water lance.

The multihull vessel has a built in hydraulic power unit, allowing divers to use hydraulically operated tools under water, and the crew to use hydraulically operated tools topside, even simultaneously. A power sheave can be operated, as an example with the hydraulic power unit.

In one or more embodiments, the multihull vessel can be equipped with a nitrox diving system, which can reduce dive crew size and increase diver bottom time. Nitrox can be any gas mixture composed of nitrogen and oxygen, excluding trace gases.

By having a nitrox diving system, the vessel is expected to offer improved safety by simultaneously reducing decompression exposure for divers and reducing the risk of diver decompression sickness.

The vessel can include a decompression compression chamber for divers.

The multihull vessel can have vessel sensors on vessel servers to collect acoustic and/or sonar diver information, perform analysis on collected information, and transmit to a network, an administrative server, and/or client devices remote to the multihull vessel.

The multihull vessel can have an onboard dive server, a survey tracking system, an acoustic and/or sonar tracking system allowing tracking of diving operations not only from the multihull vessel, but allowing tracking of diving operations through transmission of the sensed data over a network in real time to an administrative server. The tracking can be acoustic and/or sonar tracking of divers and/or remote controlled vehicles (ROV) in addition to divers.

The administrative server on land, the onboard dive server, the onboard survey server, and an onboard client workstation can be a computer, a navigation system that can handle additional processing and data storage, an automatic identification system (AIS) that can handle additional processing and data storage, or combinations thereof.

Client devices that communicate to the network, the administrator or the vessel can be a computer, a cellular or mobile phone, a tablet, a similar device, or combinations thereof.

In embodiments, the administrative server can communicate directly with the client devices.

Signals from divers can include video signals and/or audio signals, such as dive radio communication. The signals from the divers can be collected by an onboard dive server and stored or transmitted in real time to a network.

The network can communicate to a land based administrative server and client devices that are remote to the multihull vessel and can be land based.

In embodiments, the onboard dive server can communicate to a computing cloud, which can store the transmissions for viewing by users at a later time.

The transmission to the land based administrative server and client devices enable users that are not on the multihull vessel to view live video signals from a diver or remote operated vehicle (ROV) or hear live diver radio communication or ROV operator narration.

The jet powered multihull vessel is designed to mitigate ongoing regulatory or industry pressure to limit or eliminate liveboating operations with divers.

The multihull vessel can use less fuel than heavier monohull dive vessels because it is lighter in weight and has less displacement.

The multihull vessel, in embodiments, can be lifted by crane on board a floating semisubmersible, a tension leg platform (TLP), a spar, a fixed leg platform, a drill ship, a barge, a lift boat, or other small crane bearing structure such as a dock or another floating vessel, for quick deployment and recovery, as needed.

The multihull vessel can support inspection, maintenance and repair "IMR" work as well as survey and light construction tasks at offshore platforms, tension leg platforms, shallow water locations and other offshore structures, where there is limited access for traditional dive support vessels (DSV's) or deep draft surface dive vessels, to work in close proximity to the structures or other needed areas.

The multihull vessel can be formed from a durable material that is impact resistance to about 5 foot to 10 foot wave impacts. Examples of durable material can be steel, aluminum, carbon fiber, fiberglass, or combinations thereof.

The vessel is designed to carry fuel that enables the multihull vessel to travel up to 1,000 miles without refueling.

In embodiments, the length overall of the hull can be from 38 feet to 115 feet, and wherein the overall width of the hull is from 8 feet to 40 feet.

In an embodiment, the multihull vessel can be a twin hull, twin jet drive, with client or vessel owner provided survey and USBL data into one or more onboard servers.

In this embodiment, the multihull vessel can also include a control station with dive server, a nitrox/air diving system, and a specially designed diver recovery system that improves diver safety in the event of an emergency. In this embodiment, the vessel includes dive tools for high pressure underwater hand jetting and hydraulic power use. In this example, the vessel can be operated by as few as 6 people, namely 1 diving supervisor, 2 divers, 2 tenders, and 1 marine crew.

Turning now to the Figures, FIG. 1 is a starboard side view of the self-supporting multihull vessel for dive services according to one or more embodiments.

The multihull vessel 12 is shown with a bow 15 and a stern 17. The multihull vessel 12 can also have an independently operable water jet drive 32 and a dive ladder 68.

The multihull vessel can be a catamaran with two parallel pontoons joined by some structure from the starboard to the port pontoons, or a trimaran with three parallel pontoons joined together, or a vessel with more pontoons. Each pontoon can have a high rise bow for wave cutting.

In one or more embodiments, the length overall of the multihull vessel can be from 38 feet to 115 feet, and the overall width of the multihull vessel can be from 8 feet to 40 feet.

The main deck 19 is shown above a water surface 13.

Above the main deck can be an emergency recovery davit 74. In one or more embodiments, the multihull vessel can include a rescue craft 76 that can be lifted with the emergency recovery davit 74. The rescue craft can be an inflatable raft and can be 8 to 12 foot in length.

Figure 2:
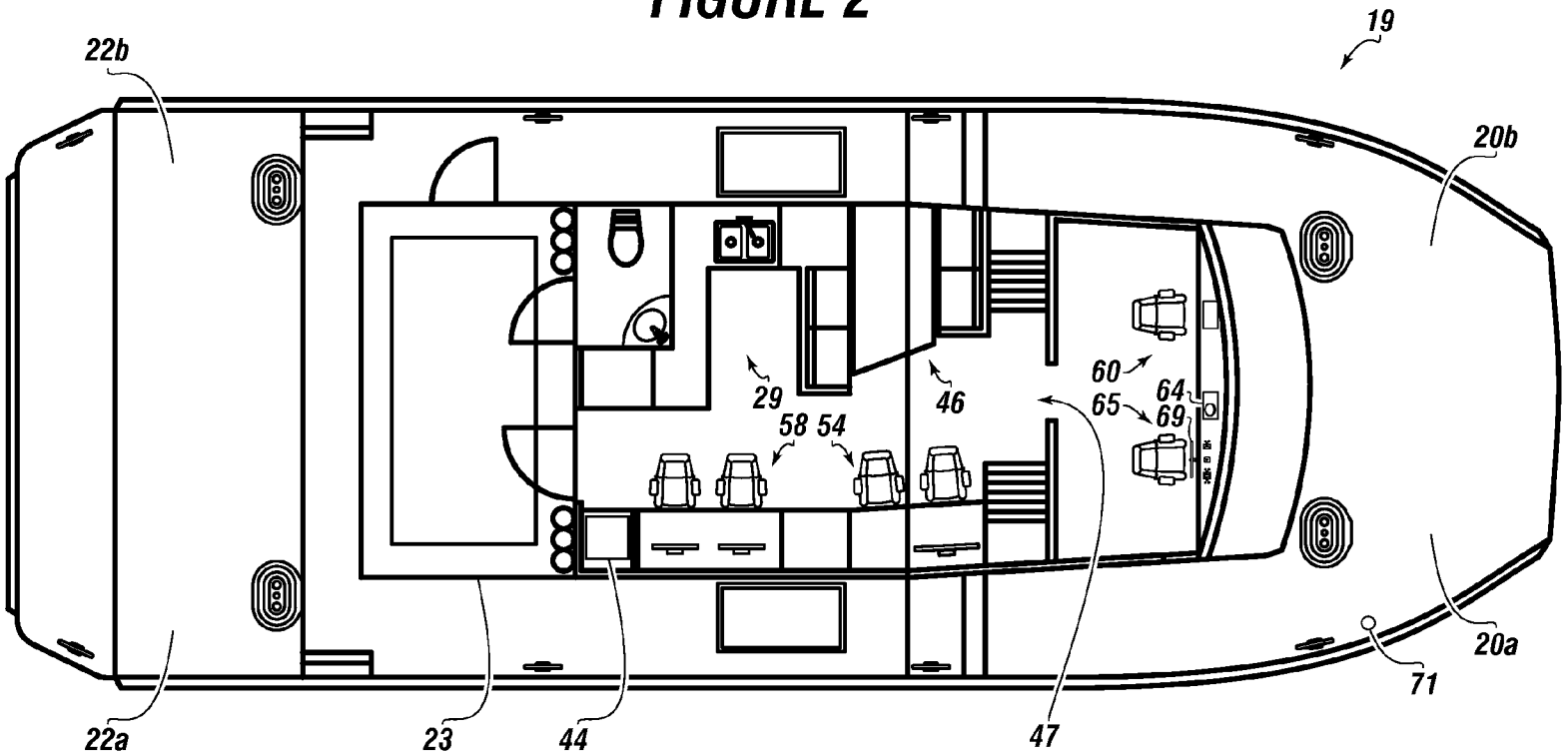
FIG. 2 is a top view of a main deck arrangement according to one or more embodiments.

FIG. 2 is a top view of a main deck arrangement according to one or more embodiments.

The main deck 19 can contain a cabin 47 with a helm 65 and navigation control 64 that can be operated by a user, such as a captain. In one or more embodiments, the cabin can be referred to as a "superstructure".

In one or more embodiments, the multihull vessel can include an automatic identification system (AIS) 69 connected to the helm 65 which can also communicate to navigation control 64.

In one or more embodiments, the main deck 19 can also contain a heating and cooling system 44 for the crew on board the multihull vessel. The heating and cooling system 44 can be located in the cabin 47.

The main deck 19 can also contain an onboard survey station 58, which can be located in the cabin 47.

The multihull vessel can include a client work station 60, a gallery 29 shown adjacent a resting area 46, a main dive control station 54, shown opposite the resting area, and a decompression chamber 23.

Bow dive support stations 20*a* and 20*b* and stern dive support stations 22*a* and 22*b* are shown. Each dive support station can include space for personnel.

Each dive support station can have a dive ladder and an air compressor fitting 71.

Figure 3:
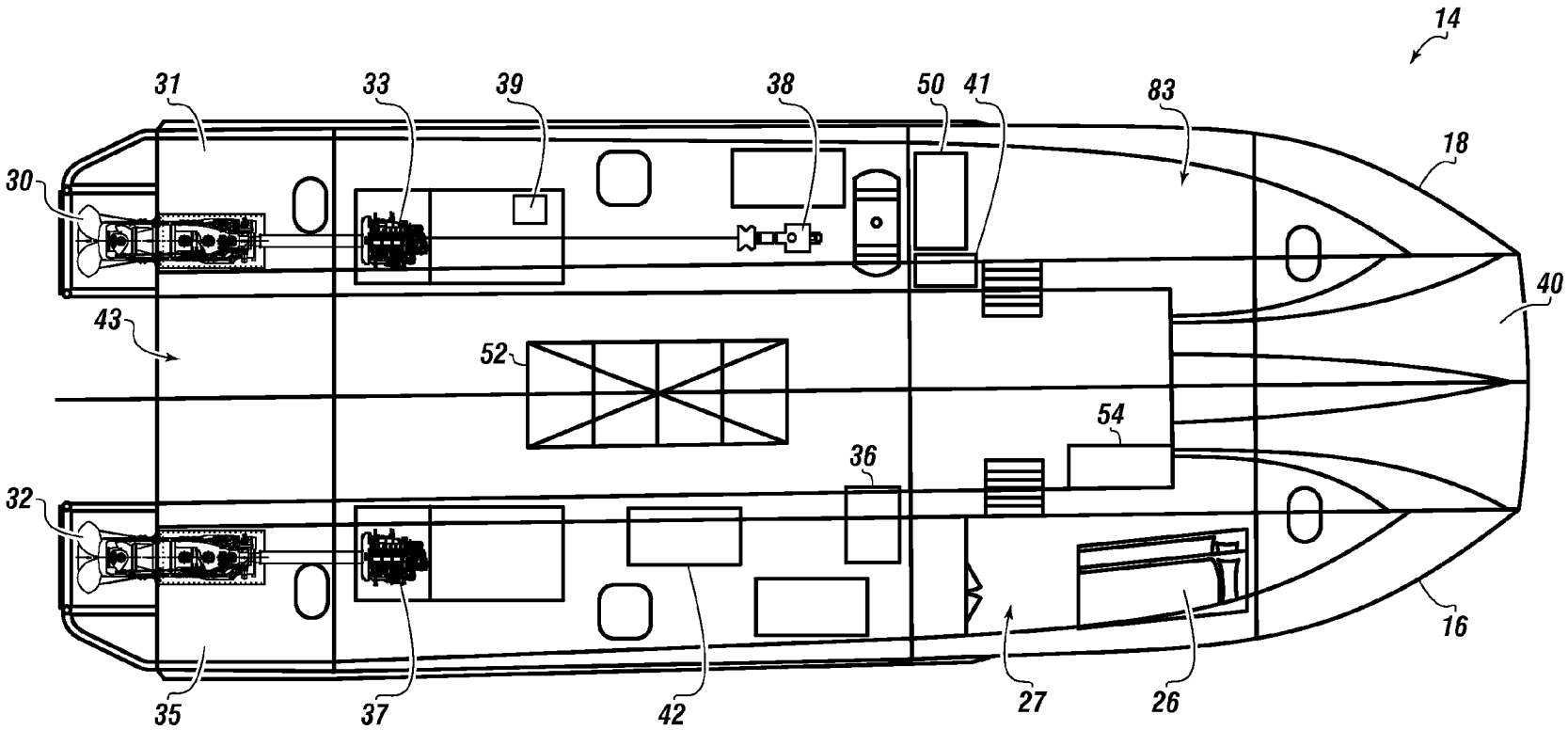
FIG. 3 is a top view of the below deck arrangement according to one or more embodiments.

FIG. 3 is a top view of the below deck arrangement according to one or more embodiments.

The multihull vessel can include a hull 14. The hull 14 can be made of at least one starboard pontoon 16 and at least one port pontoon 18 joined together.

The term "hull" as used is herein can refer to a watertight body of the ship or boat.

A bow deck 40 formed over the pontoons at the bow of the vessel and a stern deck 43 formed over the pontoons at the stern of the vessel can be used to connect the pontoons together.

The independently operable water jet drive 32 disposed in a starboard engine room 35 in the starboard pontoon 16 can be operated by a starboard diesel engine 37.

An independently operable water jet drive 30 disposed in a port engine room 31 in the port pontoon 18 can be operated by a port diesel engine 33. In one or more embodiments, onboard dive tools can be mounted in the engine room.

The port engine room 33 can include a hydraulic power unit 39. The hydraulic power unit 39 can be connected to one of the diesel engines, such as the port diesel engine 33. In embodiments, the hydraulic power unit can be connected to an auxiliary engine, which can be an electric engine or a diesel engine.

In embodiments, the diesel engine can be any diesel engine, such as a Caterpillar, Cummins, or John Deere, with a horsepower of about 600 hp or more.

A usable hydraulic power unit 39 can be mounted on one of the diesel engines and can have a flow rate from 15 gallons to 20 gallons per minute. The multihull vessel can include one or a plurality of hydraulic power units 39 that run a variety of onboard dive tools such as impact wrenches, grinders, drills, buffers, saws, or similar dive tools.

A water jetting unit 38 can be mounted in one of the hulls, which can be used for digging, or excavating with high pressure, such as over 100 psi. In embodiments, the water jetting unit can run at 400 psi.

A usable water jetting unit can be a centrifugal pump, speed increaser, with a diesel engine. For example, the water jetting unit can be a water jetting model 5×3 DMD made by Patterson Pumps of Georgia.

In one or more embodiments, a plurality of mounted pressurized water stream producing units can be referred to as the "water jetting unit." The water jetting unit 38 can run a jet nozzle, water lance, water lifts, or flushing tools.

In one or more embodiments, the water jetting unit 38 can be a speed increased water jetting for providing a pressurized water stream enabling performance of an operation such as: excavation, flushing, digging, or combinations thereof. For example, the water jetting unit can be a diesel driven speed increased centrifugal pump.

In one or more embodiments, the water jetting unit 38 can pull seawater into the pump using an appurtenance, such as a sea chest.

In one or more embodiments, a fresh water system 50 can be disposed in one or both of the engine rooms. The fresh water system 50 can be used on the vessel for washing, and potentially for drinking water.

In an embodiment, the fresh water system can include a pump, which can be powered by onboard batteries and/or connected to a generator. The fresh water drinking system 50 can contain from 50 gallons to 200 gallons of water. The water can be stored in one or more tanks, and be additionally usable as ballast in an embodiment.

In other embodiments, the fresh water system can be a reverse osmosis system.

A sanitation/waste system 41 can be used on the multihull vessel for heads and kitchen effluent.

In embodiments, the area below deck can include equipment space 83 to hold additional dive equipment, including but not limited to tanks, dive hoses, ropes, dive helmets, duct tape, regulators, and other diver tools.

A generator 42 can be mounted in one of the engine rooms, such as the starboard engine room 35.

The generator can be a diesel electric generator. For example, the generator can be a generator made by Northern Lights, Inc. More than one generator can be used in the vessel and the generators can be connected together in series or in parallel.

The generator 42 and can connect to the dive compressor 36 as well as provide shipboard power.

The dive compressor can be part of a dive system that includes equipment for providing diving services. The generator can provide power to a portion or portions of the dive system.

The multihull vessel 12 can include at least one fuel tank 52. In embodiments a plurality of fuel tanks can be used, such as a plurality of smaller fuel tanks which can be connected together or used as disparate, disconnected tanks.

The fuel tank 52 can flow fuel, such as diesel fuel, to the generator 42, the starboard diesel engine 37, the port diesel engine 33, and the water jetting unit 38.

The dive compressor 36, such as a nitrox compressor, can be mounted in one or more of the engine rooms and placed in fluid communication with the main dive control station 54.

The multihull vessel can have accommodations 27 adjacent one or both of the engine rooms with bunks 26, and storage, for crew.

Figure 4:
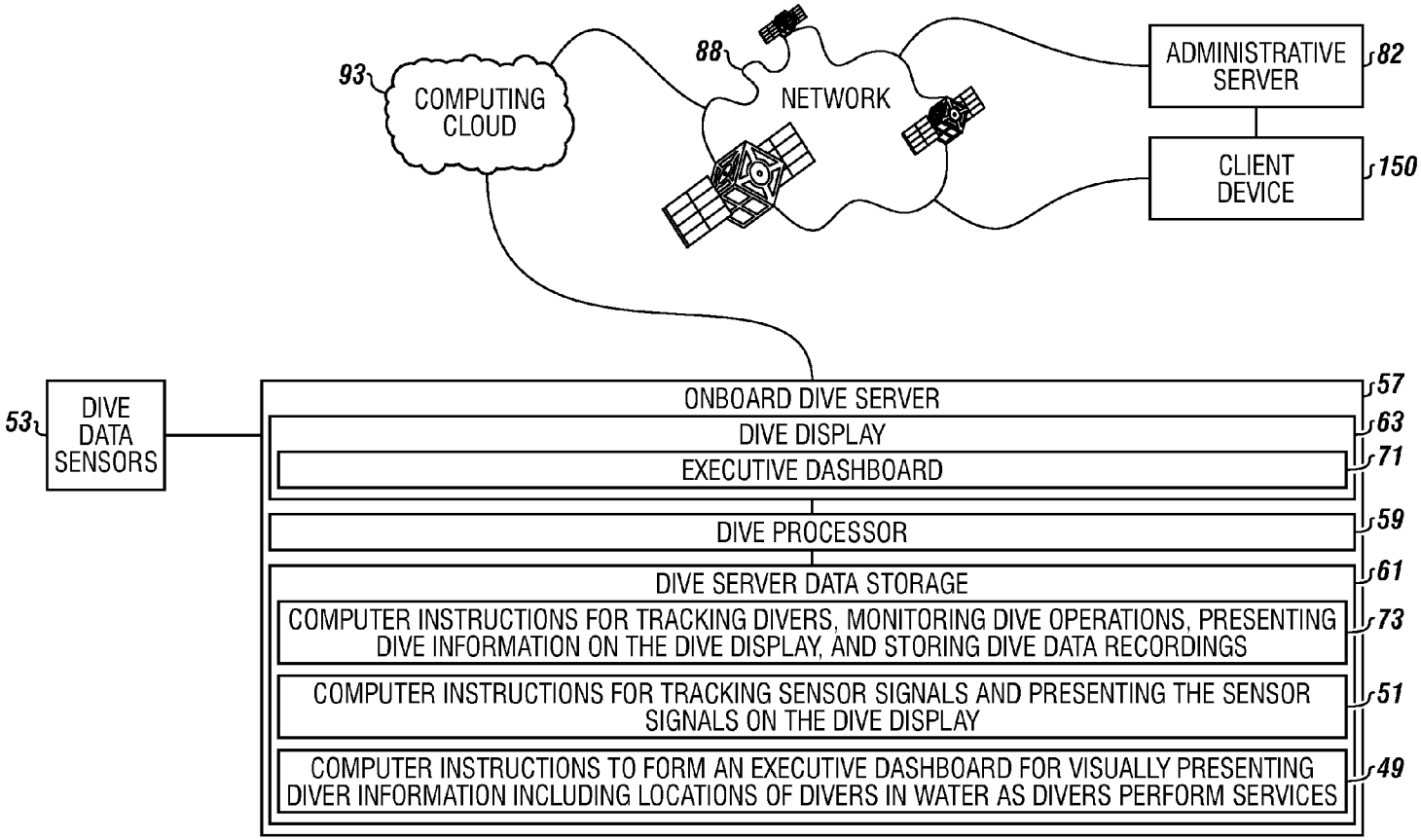
FIG. 4 is a diagram of an onboard dive server according to one or more embodiments.

FIG. 4 is a diagram of an onboard dive server according to one or more embodiments.

The onboard dive server 57, which can be a computer, can include a dive processor 59 in communication with dive server data storage 61, and a dive display 63, for visually presenting diver information including the acoustic and/or sonar locations of divers in water performing services using an executive dashboard 71.

The dive processor 59 can receive sensor signals from one or more on dive data sensors 53 and can be used for connecting to and removing dive data recordings from dive data sensors 53 worn by divers during dive.

The onboard dive server 57 can communicate with a network 88 and an administrative server 82 with a client device 150.

The network 88 can connect to a computing cloud 93 which can also communicate to the multihull vessel. In embodiments, the multihull vessel can communicate to both the computing cloud and the network simultaneously.

The dive server data storage 61 can contain: computer instructions 73 for tracking divers, monitoring dive operations, presenting dive information on the dive display and storing dive data recordings; computer instructions 51 for tracking sensor signals and presenting the sensor signals on the dive display; and computer instructions 49 to form an executive dashboard for visually presenting diver information including locations of divers in water as divers perform services.

Figure 5A:
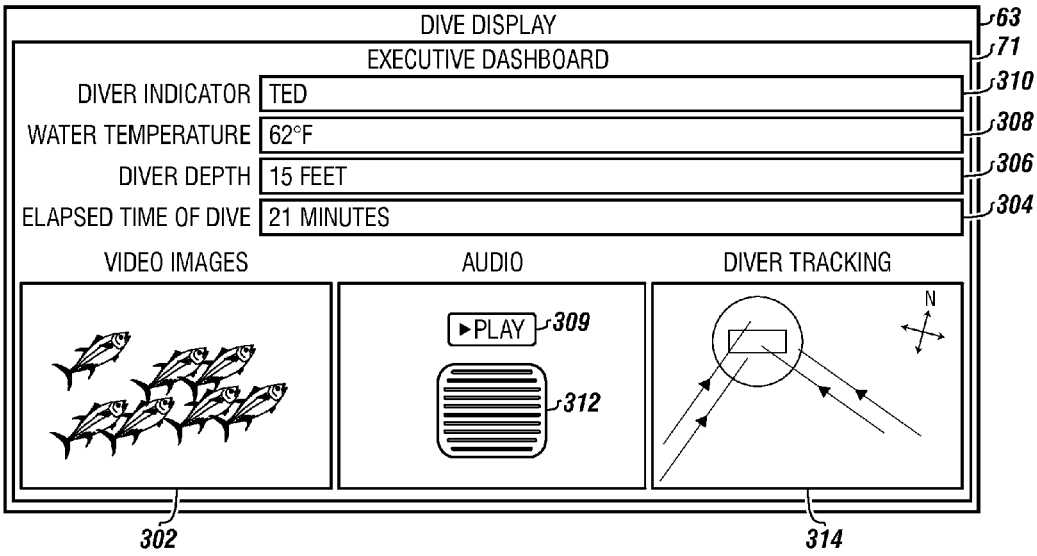
FIG. 5A shows the dive display and executive dashboard according to one or more embodiments.

FIG. 5A shows the dive display and executive dashboard according to one or more embodiments.

The executive dashboard 71 can include dive information such as diver tracking 314 which depicts acoustic and/or sonar diver locations in water within a specific geographical location, and video images 302 from divers in the water performing services.

The video images 302 can be from a camera from a diver helmet or an underwater video camera. The video images 302 can be captured in real time from one or more of the divers and stored as a video image on the dive processor.

The executive dashboard 71 can include a diver indicator 310, such as the name or code for the diver, shown here as Ted. The executive dashboard 71 can include an elapsed time of dive 304, shown as 21 minutes. The executive dashboard 71 can show a diver depth 306, shown as 15 feet, as well as water temperature 308, shown as 62 degrees Fahrenheit.

The executive dashboard 71 can present a button 309 to play an audio feed from a diver over a speaker 312 attached to the dive display 63. In one or more embodiments, the speaker 312 can be mounted on the dive display 63.

Figure 5B:
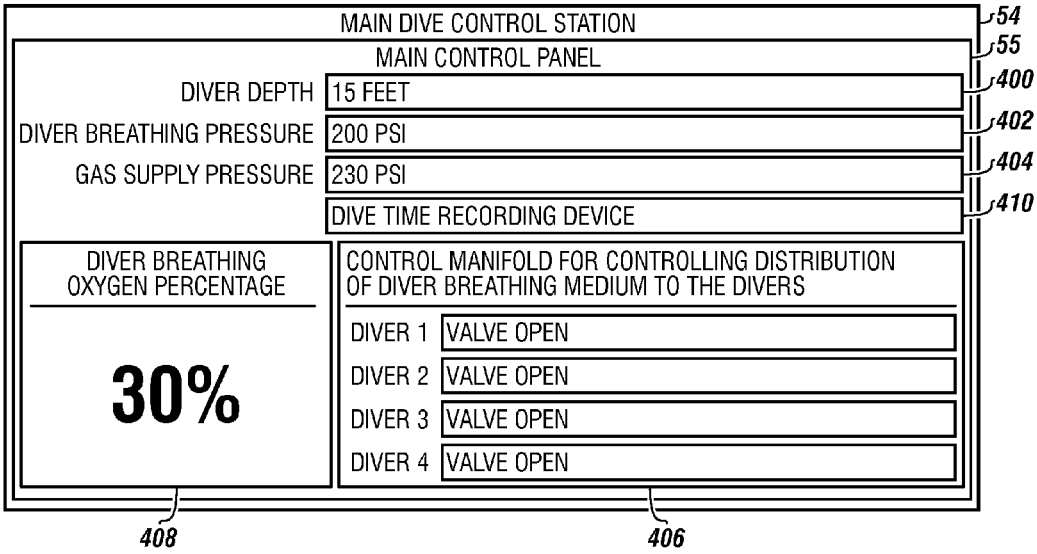
FIG. 5B shows the main dive control station and the main control panel according to one or more embodiments.

FIG. 5B shows the main dive control station and the main control panel according to one or more embodiments.

The main dive control station 54 has a main control panel 55, which can provide a diver depth 400, shown as 15 feet, a diver breathing pressure 402, shown as 200 psi; a gas supply pressure 404, such as 230 psi; a control manifold 406 for controlling distribution of diver breathing medium to the divers; diver breathing oxygen percentage 408, shown as 30 percent, and a dive time recording device 410.

Figure 6:
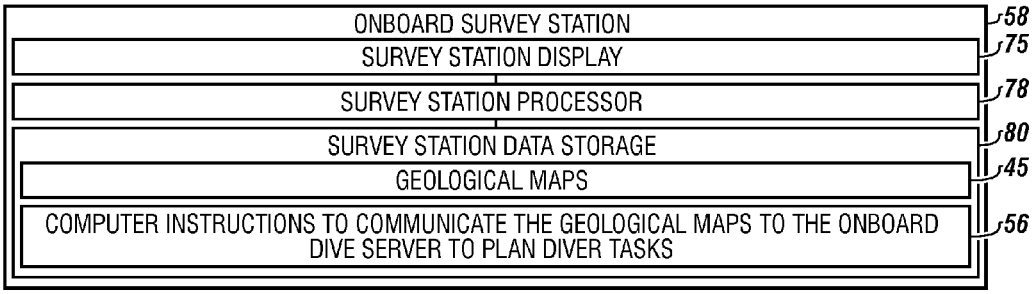
FIG. 6 depicts the onboard survey station according to one or more embodiments.

FIG. 6 depicts the onboard survey station according to one or more embodiments.

The onboard survey station 58 can include a survey station processor 78 and a survey station data storage 80 with geological maps 45 and computer instructions 56 to communicate the geological maps to the onboard dive server to plan diver tasks. The onboard survey station 58 can communicate to the onboard dive server.

In one or more embodiments, the onboard survey station 58 can include an onboard computer or processor with survey station data storage 80 for survey information about the dive site.

The onboard survey station 58 can include a survey station display 75 for presenting diver locations, remote controlled vehicle locations, multihull vessel locations, and combinations thereof.

Figure 7:
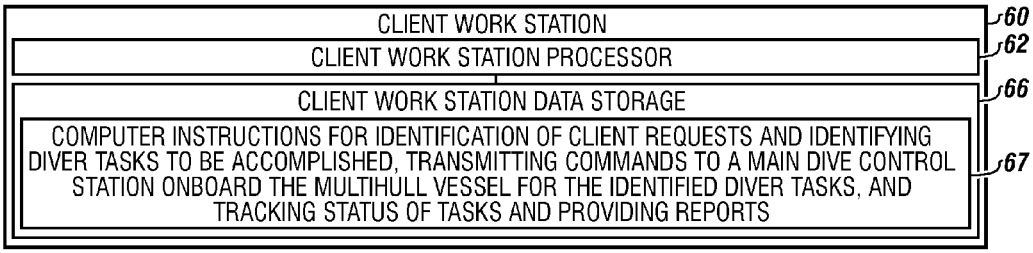
FIG. 7 depicts the client work station according to one or more embodiments.

FIG. 7 depicts the client work station according to one or more embodiments.

The client work station 60 can have a client work station processor 62 in communication with client work station data storage 66, which can be a laptop or desk top computer.

The work station data storage can have computer instructions 67 for identification of client requests and identifying diver tasks to be accomplished, transmitting commands to a main dive control station onboard the multihull vessel for the identified diver tasks, and tracking status of tasks and providing reports. These computer instructions can additionally communicate those reports via a network to a remote location, such as an administrative server.

Figure 8:
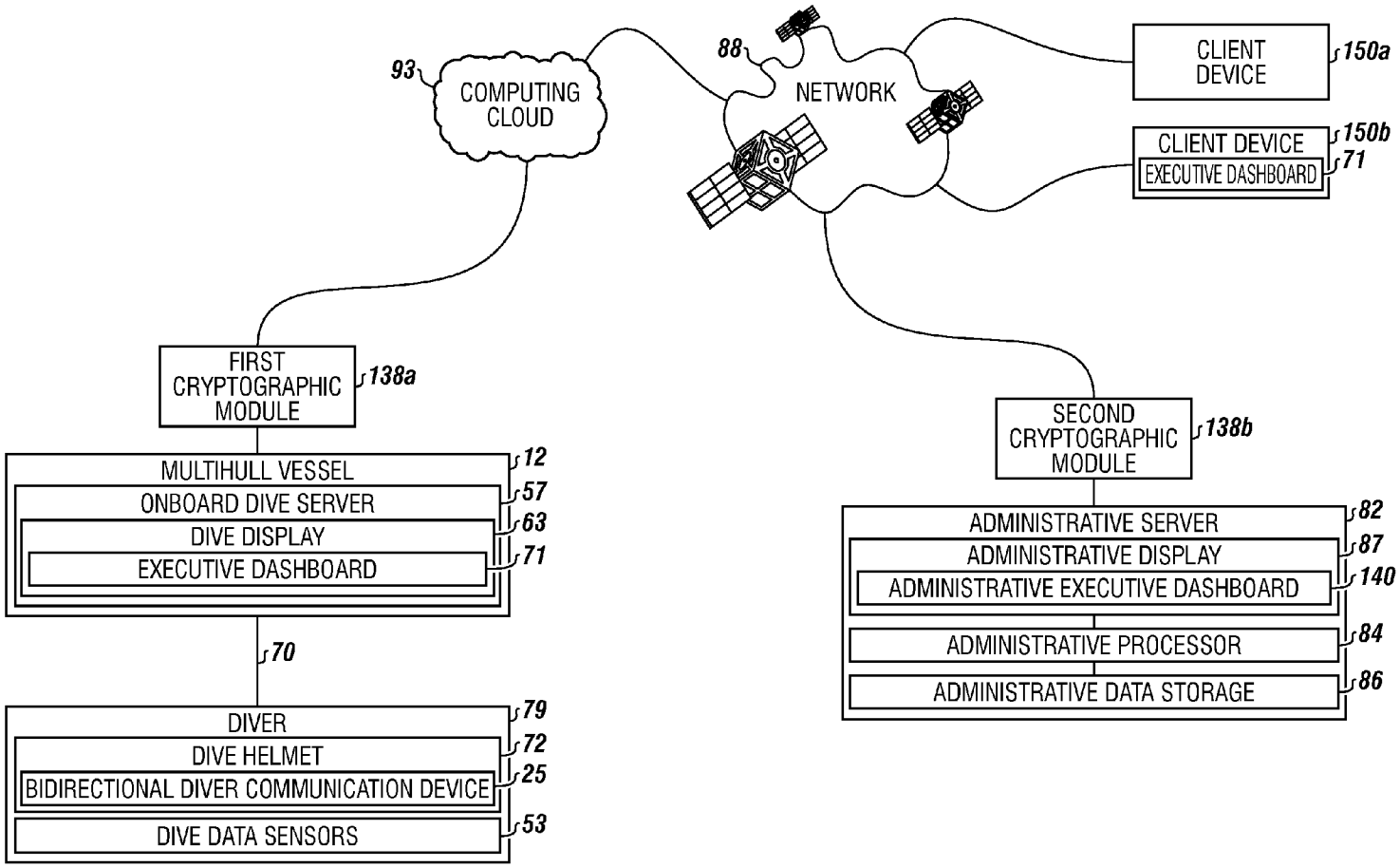
FIG. 8 is a diagram of the bidirectional communication between diver, multihull vessel, network, administrative server, and client devices, wherein the administrative server and client devices are remote to the multihull vessel.

FIG. 8 is a diagram of the bidirectional communication between diver, multihull vessel, network, administrative server, and client devices, wherein the administrative server and client devices are remote to the multihull vessel.

The multihull vessel 12 can communicate to an administrative server 82 through a network 88, which can be a satellite network, or a combination of networks.

The network 88 can connect to a computing cloud 93 which can also communicate to the multihull vessel 12. In embodiments, the multihull vessel 12 can communicate to both the computing cloud 93 and network 88 simultaneously.

The administrative server 82 can include an administrative processor 84 and an administrative data storage 86 in communication with an administrative display 87.

The administrative display 87 can be used for viewing an administrative executive dashboard 140 populated with diver information, diver tracking information, and diver images, audio transmission, and other information from the multihull vessel 12 via the network 88, the computing cloud 93, or both.

A diver 79 can have a bidirectional diver communication device 25 mounted in a dive helmet 72. The bidirectional diver communication device 25 can enable the diver 79 to communicate directly via a communication cable or a dive hose 70 with a supervisor located onboard the multihull vessel.

The dive hose 70 can also be a breathing medium from the multihull vessel to the in-water diver 79.

Information from the diver 79 and the dive data sensors 53 can be transmitted to the onboard dive server 57 and the dive display 63 that simultaneously presents the executive dashboard 71 the diver information, diver tracking and diver images, audio information, for viewing on the multihull vessel.

Additionally, a first cryptographic module 138*a* can be connected to the network 88 can encrypt signals from the multihull vessel to the administrative server. In embodiments, a second cryptographic module 138*b* can also be used between the administrative server and the multihull vessel 12.

The network 88 and the administrative server 82 can both communicate additionally with one or more client devices 150*a* and 150*b*. The client devices can present the executive dashboard 71 or the administrative executive dashboard, 140 or both dashboards, simultaneously.

Figure 9:
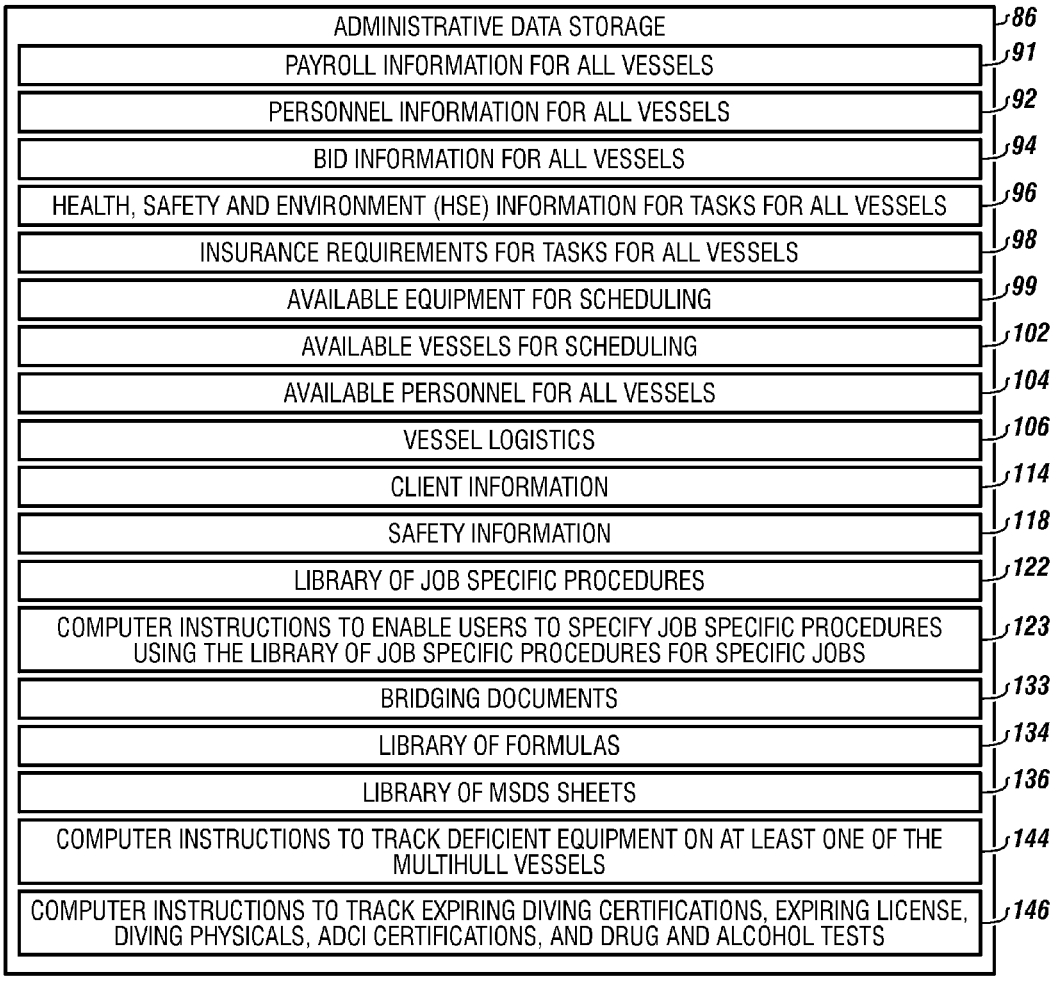
FIG. 9 is a diagram of the administrative data storage according to one or more embodiments.

FIG. 9 is a diagram of the administrative data storage according to one or more embodiments.

The computer instructions in the administrative data storage 86 can be land based, or based at a location remote to the multihull vessel, according to one or more embodiments.

The administrative data storage 86 can include payroll information for all vessels 91.

The administrative data storage 86 can include personnel information for all vessels 92. Personnel information can include skill level, certifications, and hourly rates.

The administrative data storage 86 can include bid information for all vessels 94. Bid information can include the rate at which a project is being billed out, with detail on out of pocket costs.

The administrative data storage 86 can include health, safety and environment (HSE) information for tasks for all vessels 96.

The administrative data storage 86 can include insurance requirements for tasks for all vessels 98.

The administrative data storage 86 can include available equipment for scheduling 99.

The administrative data storage 86 can include available vessels for scheduling 102.

The administrative data storage 86 can include available personnel for all vessels 104. The term "available personnel for all vessels" can include includes titles, certifications, experiences, and rates.

The administrative data storage 86 can include vessel logistics 106. The vessel logistics can include vessel location, such as a longitude and latitude, a vessel schedule such as days available with per diem rates; vessel drydock plan such as the 3 weeks for painting the bottom of the vessel, and combinations thereof.

The administrative data storage 86 can include client information 114. Client information can include scope of work, job specific procedures, underwater project age, underwater project location, underwater project dimensions including wall thicknesses, underwater project materials, estimated depths of underwater project, underwater project capacity, last repair date of all or portions of the underwater project, and as-built drawings of all or portions of an underwater project.

The administrative data storage 86 can include safety information 118.

The safety information can include a dive safety manual with all information on processes, procedures and policies required for diving, a safe work plan which lists a project task and a mitigation of risks, and who is responsible for mitigation of risks, and emergency procedures such as hospital information, phone contact, helicopter lift off contacts.

The dive safety manual can include bottom times, decompression schedules, and diver job safety analysis forms.

The administrative data storage 86 can include a library of job specific procedures 122.

A library of job specific procedures can contain generic diving tasks steps, such as air bag use, flange make up, tender operations, and similar tasks.

The administrative data storage 86 can include computer instructions 123 to enable users to specify job specific procedures using the library of job specific procedures for specific jobs, such as welding, cleaning, excavating, and inspecting.

The administrative data storage 86 can include bridging documents 133, such as a list of phone numbers of platforms offshore with longitude and latitude indicators and as-built drawings of all or portions of an underwater project.

The administrative data storage 86 can contain a plurality of libraries. A library of formulas 134 for offshore diving projects comprising gas consumption formula, partial pressure formulas for decompression times, and atmospheres; and a library of MSDS sheets 136 are shown.

In one or more embodiments, the administrative server 86 can include computer instructions 144 to track deficient equipment on at least one of the multihull vessels, and/or computer instructions 146 to track expiring diving certifications, expiring license, diving physicals, ADCI certifications, and drug and alcohol tests.

Figure 10A:
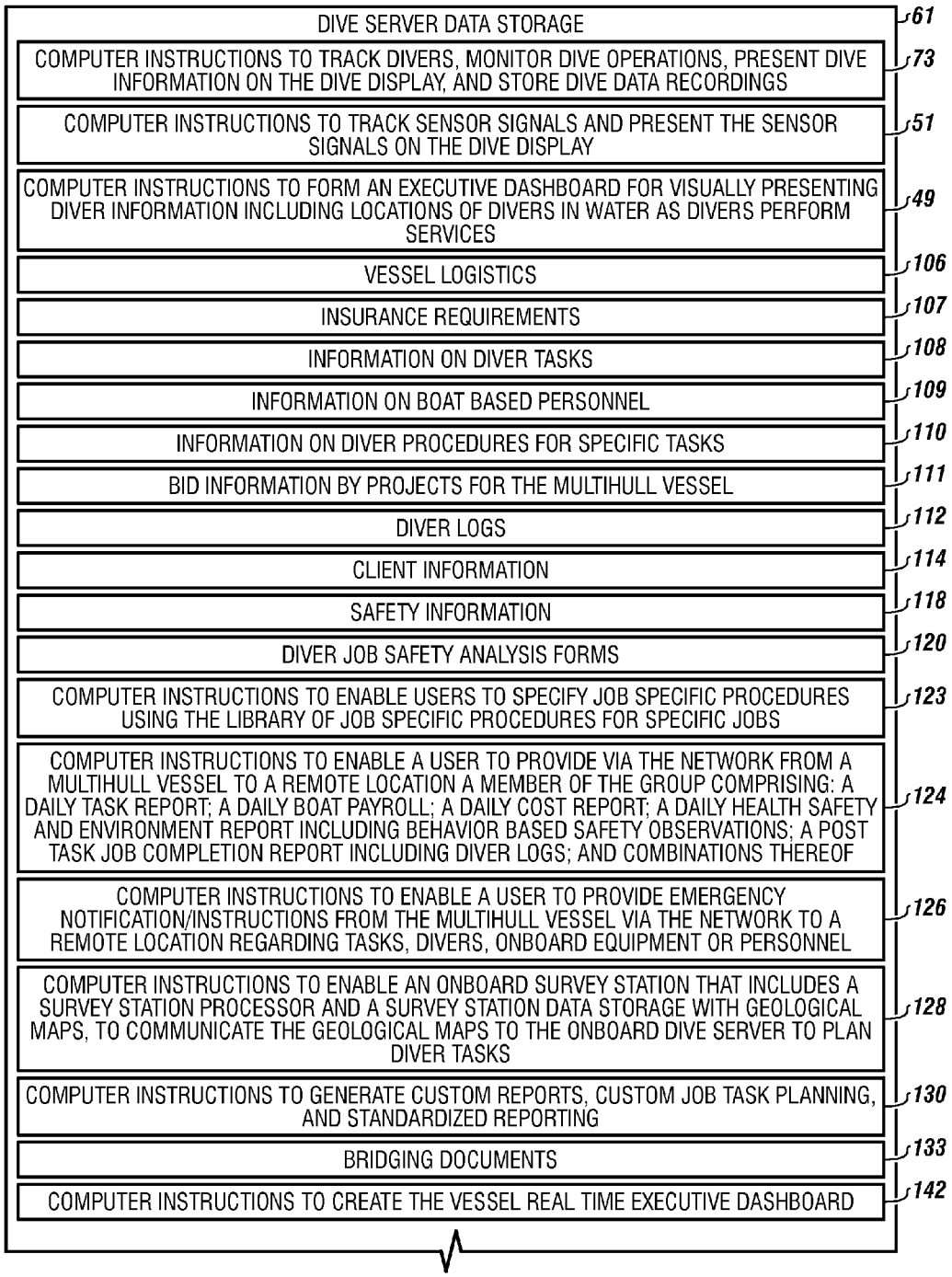
FIGS. 10A and 10B are a diagram of the dive server data storage according to one or more embodiments.
Figure 10B:
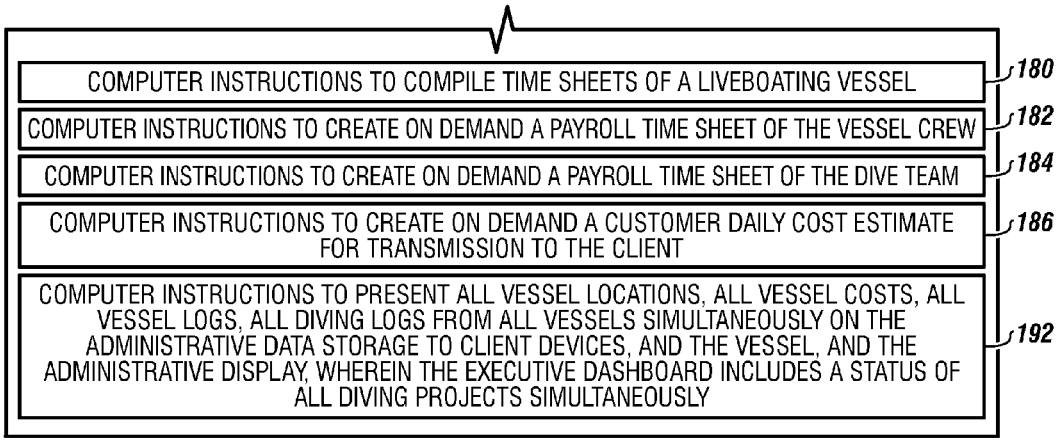

FIGS. 10A and 10B are a diagram of the dive server data storage according to one or more embodiments.

The dive server data storage 61 can include computer instructions 73 to track divers, monitor dive operations, present dive information on the dive display, and store dive data recordings.

The dive server data storage 61 can include computer instructions 51 to track sensor signals and present the sensor signals on the dive display.

The dive server data storage 61 can include computer instructions 49 to form an executive dashboard for visually presenting diver information including locations of divers in water as divers perform services.

The dive server data storage 61 can include vessel logistics 106. The vessel logistics can include a vessel location; a vessel schedule; a vessel drydock plans; and combinations thereof.

The dive server data storage 61 can include insurance requirements 107.

The dive server data storage 61 can include information on diver tasks 108.

The dive server data storage 61 can include information on boat based personnel 109.

The dive server data storage 61 can include information on diver procedures for specific tasks 110.

The dive server data storage 61 can include bid information by projects for the multihull vessel 111.

The dive server data storage 61 can include diver logs 112, which can includes time sheets.

The dive server data storage 61 can include client information 114, which can include at least one scope of work and at least one underwater project location.

The dive server data storage 61 can include safety information 118.

The safety information can include a dive safety manual with all information on processes, procedures and policies required for diving, a safe work plan which lists a project task and a mitigation of risks, and who is responsible for mitigation of risks, and emergency procedures such as hospital information, phone contact, helicopter lift off contacts.

The dive server data storage 61 can include diver job safety analysis forms 120.

The dive server data storage 61 can include computer instructions 123 to enable users to specify job specific procedures using the library of job specific procedures for specific jobs.

The library of job specific procedures can include specific procedures on how to how to profile a pipeline, how to inspection a platform, how to clean without polluting, how to dig to a designated depth given sea bottom materials, how to inspect for pipeline leaks, and similar tasks.

The dive server data storage 61 can include computer instructions 124 to enable a user to provide via the network from a multihull vessel to a remote location a member of the group comprising: a daily task report; a daily boat payroll; a daily cost report; a daily health safety and environment report including behavior based safety observations; a post-task job completion report including diver logs; and combinations thereof.

The dive server data storage 61 can include computer instructions 126 to enable a user to provide emergency notification/instructions from the multihull vessel via the network to a remote location regarding tasks, divers, onboard equipment or personnel.

The dive server data storage 61 can include computer instructions 128 to enable an onboard survey station that includes a survey station processor and a survey station data storage with geological maps, to communicate the geological maps to the onboard dive server to plan diver tasks.

The dive server data storage 61 can include computer instructions 130 to generate custom reports, custom job task planning, and standardized reporting.

The dive server data storage 61 can include bridging documents 133. The bridging documents can be a document, which can include phone numbers of platforms offshore with longitude and latitude indicators.

The dive server data storage 61 can include computer instructions 142 to create the vessel real time executive dashboard The dive server data storage 61 can include computer instructions 180 to compile time sheets of a diving vessel.

The dive server data storage 61 can include computer instructions 182 to create on demand a payroll time sheet of the vessel crew.

The dive server data storage 61 can include computer instructions 184 to create on demand a payroll time sheet of the dive team.

The dive server data storage 61 can include computer instructions 186 to create on demand a customer daily cost estimate for transmission to the client.

The dive server data storage 61 can include computer instructions 192 to present all vessel locations, all vessel costs, all vessel logs, all diving logs from all vessels simultaneously on the administrative data storage to client devices, and the vessel, and the administrative display, wherein the executive dashboard includes a status of all diving projects simultaneously.

Figure 11A:
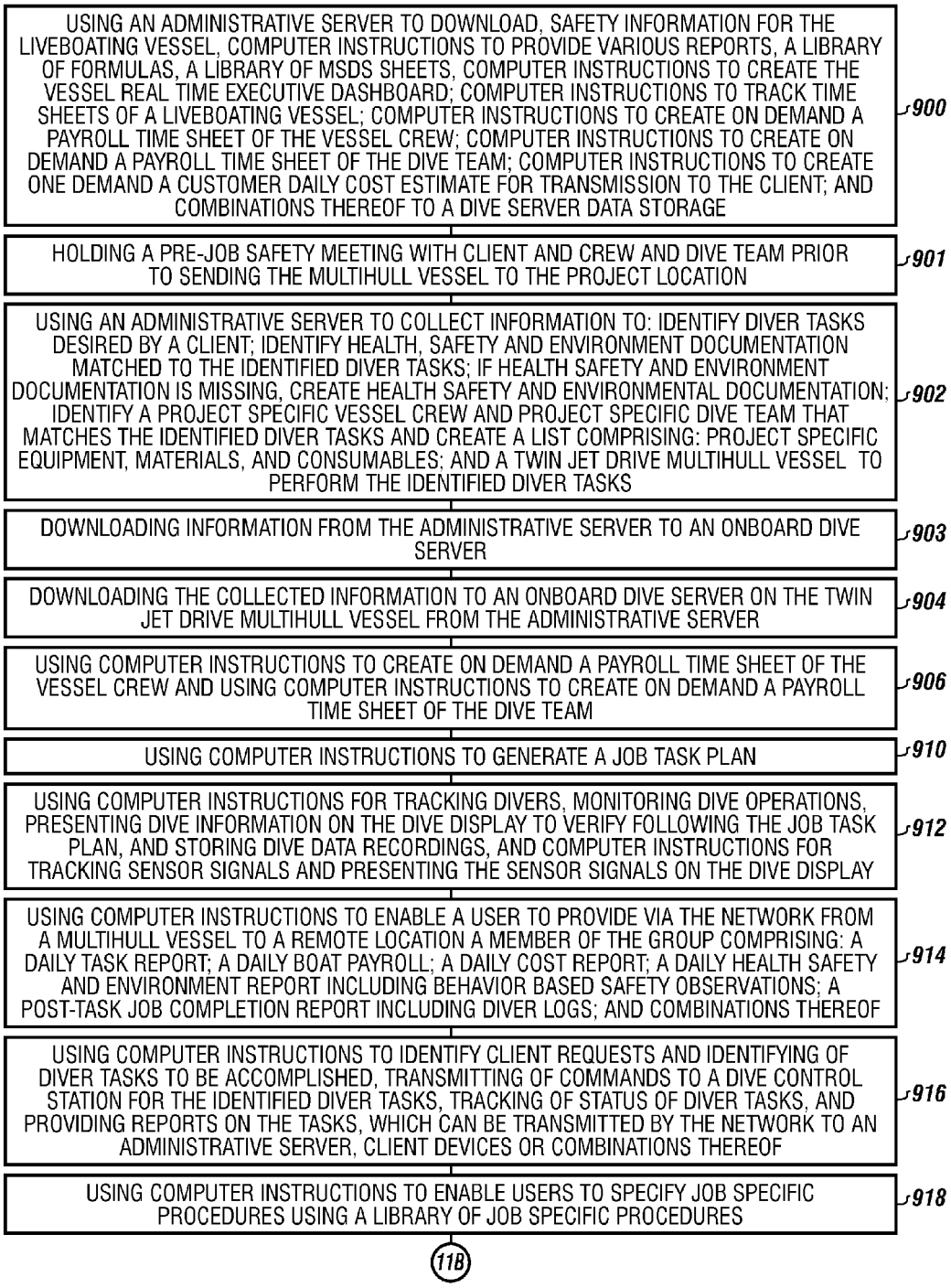
FIGS. 11A and 11B depict steps of a method for performing diver tasks using a multihull vessel with onboard water jet, connected to a network, administrative server, and client devices.
Figure 11B:
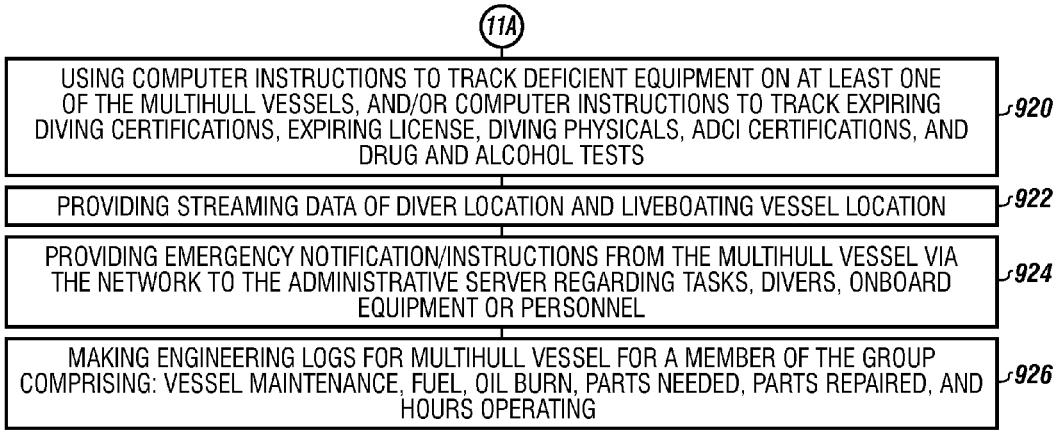

FIGS. 11A and 11B depict steps of a method for performing diver tasks using a multihull vessel with onboard water jetting, connected to a network, administrative server, and client devices.

In embodiments of the method, step 900 at project conception an administrative server is used to download the following information to a dive server data storage.

The information includes safety information for the diving vessel, computer instructions to provide various reports, a library of formulas, a library of MSDS sheets, computer instructions to create the vessel real time executive dashboard; computer instructions to track time sheets of a diving vessel; computer instructions to create on demand a payroll time sheet of the vessel crew; computer instructions to create on demand a payroll time sheet of the dive team; computer instructions to create one demand a customer daily cost estimate for transmission to the client; and combinations thereof.

The method further includes step 901, prior to sending the multihull vessel to the project location holding a pre-job safety meeting with client and crew and dive team.

The method continues with step 902 using an administrative server to collect information to: identify diver tasks desired by a client; identify health, safety and environment documentation matched to the identified diver tasks; if health safety and environment documentation is missing, create health safety and environmental documentation; identify a project specific vessel crew and project specific dive team that matches the identified diver tasks and create a list comprising: project specific equipment, materials, and consumables; and a twin jet drive multihull vessel to perform the identified diver tasks.

In embodiments, this step can be performed daily during the life of the project.

As step 903, the method includes downloading information from the administrative server to an onboard dive server.

The information this step can include client information; bid information for projects for the multihull vessel; information on identified diver tasks; information on diver procedures for identify diver tasks; information on multihull vessel based personnel; library of job specific procedures; and a bridging document.

The method includes as step 904 downloading the collected information to an onboard dive server on the twin jet drive multihull vessel from the administrative server.

In embodiments, this step can be performed daily during the life of the project.

The method includes as step 906 using computer instructions to create on demand a payroll time sheet of the vessel crew and using computer instructions to create on demand a payroll time sheet of the dive team.

In embodiments, this step can be performed daily during the life of the project.

The method as step 910 includes using computer instructions to generate a job task plan.

In embodiments, this step can be performed daily during the life of the project.

The method as step 912 includes using computer instructions for tracking divers, monitoring dive operations, presenting dive information on the dive display to verify following the job task plan, and storing dive data recordings, and computer instructions for tracking sensor signals and presenting the sensor signals on the dive display.

In embodiments, this step can be performed daily during the life of the project.

The method includes as step 914 using computer instructions to enable a user to provide via the network from a multihull vessel to a remote location a member of the group comprising: a daily task report; a daily boat payroll; a daily cost report; a daily health safety and environment report including behavior based safety observations; a post-task job completion report including diver logs; and combinations thereof.

In embodiments, this step can be performed daily during the life of the project.

The method includes as step 916 using computer instructions to identify client requests and identifying of diver tasks to be accomplished, transmitting of commands to a main dive control station for the identified diver tasks, tracking of status of diver tasks, and providing reports on the tasks, which can be transmitted by the network to an administrative server, client devices or combinations thereof.

In embodiments, this step can be performed daily during the life of the project.

The method includes as step 918 using computer instructions to enable users to specify job specific procedures using a library of job specific procedures.

In embodiments, this step can be performed daily during the life of the project.

The method includes as step 920 using computer instructions to track deficient equipment on at least one of the multihull vessels, and/or computer instructions to track expiring diving certifications, expiring license, diving physicals, ADCI certifications, and drug and alcohol tests.

The method includes as step 922 providing streaming data of diver location and diving vessel location.

In embodiments, this step can be performed continuously during the life of the project.

In embodiments, the method can include as a step 924 providing emergency notification/instructions from the multihull vessel via the network to the administrative server regarding tasks, divers, onboard equipment or personnel.

In embodiments, this step can be performed continuously during the life of the project and can take place at any time between steps 901 and 920.

In embodiments, the method can include as a step 926 making engineering logs for multihull vessel for a member of the group comprising: vessel maintenance, fuel, oil burn, parts needed, parts repaired, and hours operating.

In embodiments, this step can be performed continuously during the life of the project and can take place at any time between steps 901 and 926.

In one or more embodiments, the engine rooms can have an engine compartment fire suppressant system.

In one or more embodiments, the hull can be entirely a metal, a metal alloy, such as steel, aluminum, or combinations thereof, carbon fiber or fiberglass.

In one or more embodiments, the multihull vessel can have a draft from 2.5 feet to 6 feet. In one or more embodiments, the multihull vessel can plane from 16 knots to 28 knots.

In one or more embodiments, a portion of each pontoon can be raked.

While these embodiments have been described with emphasis on the embodiments, it should be understood that within the scope of the appended claims, the embodiments might be practiced other than as specifically described herein.

What is claimed is:

1. A self-supporting multihull vessel for diving services comprising:

a. a hull comprised of at least:
   (i) a starboard pontoon; and
   (ii) a port pontoon;

b. an independently operable water jet drive, operated by a diesel engine, mounted in at least one pontoon;

c. an onboard dive compressor, wherein the onboard dive compressor is part of a dive system in communication with a main dive control station;

d. a bidirectional diver communication device for a diver, wherein the bidirectional diver communication device communicates with a diver supervisor bidirectional communication device located in the main dive control station;

e. a plurality of onboard dive tools, wherein the onboard dive tools comprising a member of the group consisting of:
   (i) a water jetting unit mounted in the hull connected to the diesel engine; and
   (ii) a hydraulic power unit connected to the diesel engine or an auxiliary engine;

f. a generator for providing power to the dive system, any portion of the dive system, or the multihull vessel;

g. a fuel tank in fluid communication with the water pump unit, the generator, or the diesel engine;

h. the main dive control station further comprises:
   (i) a main control panel for monitoring and displaying dive equipment and diver status;
   (ii) an onboard dive server for communicating with a network and an administrative server with a client device comprising:
      1. a dive processor for connecting to and removing dive data recordings from dive data sensors worn by divers during dives;
      2. a dive server data storage;
      3. a dive display connected to the dive control station data storage;
      4. computer instructions in the dive server data storage for tracking divers, monitoring dive operations, presenting dive information on the dive display, and storing dive data recordings;
      5. computer instructions in the dive control station data storage for tracking sensor signals and presenting the sensor signals on the dive display; and
      6. computer instructions to form an executive dashboard for visually presenting diver information including locations of divers in water as divers perform services; and i. a helm control connected to a navigation control and the jet drives.

2. The multihull vessel of claim 1, wherein each pontoon consists of a metal selected from the group: steel, aluminum, or combinations thereof.

3. The multihull vessel of claim 1, wherein each pontoon consists of carbon fiber or fiberglass.

4. The multihull vessel of claim 1, wherein the self-supporting multihull vessel has a draft from 2.5 feet to 6 feet.

5. The multihull vessel of claim 1, wherein a portion of each pontoon is raked.

6. The multihull vessel of claim 1, wherein the fuel tank contains fuel enabling operation of the multihull vessel from 100 to 1,000 miles without refueling.

7. The multihull vessel of claim 1, wherein the water jetting unit provides a pressurized water stream enabling performance of: excavation, flushing, digging, or combinations thereof.

8. The multihull vessel of claim 1, wherein the hull has an overall length from 38 feet to 115 feet, and wherein the hull has an overall width from 8 feet to 40 feet.

9. The multihull vessel of claim 1, further comprising accommodations adjacent or above at least one of the engine rooms, the accommodations comprising:

a. bunks;
b. a galley;
c. a sanitation/waste water system;
d. a heating and cooling system;
e. a resting area;
f. a fresh water system; and
g. combinations thereof.

10. The multihull vessel of claim 1, wherein each dive support station comprises: space for at least 1 personnel, a dive ladder, at least one dive hose, at least one dive helmet connected to the dive hose.

11. The multihull vessel of claim 1, further comprising an emergency recovery davit.

12. The multihull vessel of claim 1, further comprising a dive rescue craft.

13. The multihull vessel of claim 1, further comprising an onboard survey station with a survey station processor and a survey station data storage connected to the survey station processor and a survey station display in communication with the survey station processor for providing information on pipelines, underwater structures and other stored survey data to the helm control and the main dive control station, a client workstation, wherein the onboard survey station comprises: computer instructions to track and present on the survey station display, diver locations, remote controlled vehicle locations, dive multihull vessel locations, and combinations thereof.

14. The multihull vessel of claim 1, further comprising a client work station, wherein the client work station comprises: a work station processor connected to a work station data storage and computer instructions in the work station data storage identifying client requests and identification of diver tasks to be accomplished, transmitting of commands to a dive control station for the identified diver tasks, tracking of status of diver tasks, and providing reports on the tasks, which can be transmitted by the network to an administrative server, client devices or combinations thereof.

15. The multihull vessel of claim 1, further comprising an automatic identification system (AIS) connected to the helm control.

16. The multihull vessel of claim 1, further comprising a decompression chamber.

17. The multihull vessel of claim 1, further comprising a cabin mounted over the pontoons connecting the pontoons and containing accommodation, helm control, navigation control, and main dive control station.

18. The multihull vessel of claim 1, wherein the sensor signals are a member of the group consisting of: diver depth, elapsed time of dive, ambient water temperature around a diver, video feed from a diver, audio feed from a diver, and combinations thereof.

19. The multihull vessel of claim 1, wherein the main control panel further monitors nitrox mixtures, oxygen percentage for diver use; diver breathing mixture pressure, and combinations thereof.

20. The multihull vessel of claim 1, further comprising computer instructions for receiving sonar tracking, communicating with the survey processors, and displaying the results on the dive display.

21. The multihull vessel of claim 1, wherein the main control panel comprises: a diver depth, diver breathing pressure, panel gas supply pressure, diver breathing oxygen percentage, a control manifold for controlling distribution of diver breathing medium to the divers, dive time recording device and combinations thereof.

* * * * *